US005082384A

United States Patent [19]

Kakaguchi

[11] Patent Number: 5,082,384

[45] Date of Patent: Jan. 21, 1992

[54] PAPER DETECTING APPARATUS FOR PRINTER

[75] Inventor: Kazuhiro Kakaguchi, Kawasaki, Japan

[73] Assignee: Fujitsu Limited, Kawasaki, Japan

[21] Appl. No.: 614,171

[22] Filed: Nov. 15, 1990

[30] Foreign Application Priority Data

Nov. 20, 1989 [JP] Japan ..... 1-301017

[51] Int. Cl.[5] ..... B41J 29/42

[52] U.S. Cl. ..... 400/708; 400/605; 400/711

[58] Field of Search ..... 400/708, 711, 703, 605; 271/176, 227, 258, 259, 262, 265

[56] References Cited

U.S. PATENT DOCUMENTS 4,671,441 6/1987 Hauslaib ..... 400/708
4,690,577 9/1987 Kikuchi et al. ..... 400/708
4,793,605 12/1988 Tajima ..... 400/708
4,913,575 4/1990 Wada ..... 400/708
4,917,512 4/1990 Mimura et al. ..... 400/708

*Primary Examiner*—Edgar S. Burr
*Assistant Examiner*—Stephen R. Funk
*Attorney, Agent, or Firm*—Armstrong, Nikaido, Marmelstein, Kubovcik & Murray

[57] ABSTRACT

A paper detecting apparatus for a printer which can be produced at a low cost. The paper detecting apparatus comprises a pivotal paper detecting member for detecting paper which passes a paper transport path, and a motion converting and transmitting mechanism for converting pivotal motion of the paper detecting member and transmitting the same to a remote location. The paper detecting apparatus further includes a sensor for converting linear movement transmitted thereto by the motion converting and transmitting mechanism into an electric signal.

4 Claims, 4 Drawing Sheets

PAPER DETECTING APPARATUS FOR PRINTER

BACKGROUND OF THE INVENTION

This invention relates to a paper detecting apparatus for a printer for detecting paper which passes a paper transport path of the printer.

In conventional printers, various timings such as a timing of printing are controlled in response to passage of paper, and to this end, it is necessary to detect presence or absence of paper or an end of paper which passes a paper transport path. Such detection of paper requires paper detecting means for detecting paper in a paper transport path, means for transmitting a result of detection of the paper detecting means to a controlling section, and so forth.

A paper detecting apparatus for a printer is conventionally known wherein a detecting lever of a microswitch is provided in a paper transport path such that it detects passage of paper in the paper transport path to turn the microswitch on and such detection signal of the microswitch is transmitted by way of signal lines. Another paper detecting apparatus is also known wherein a photo-sensor is provided across a paper transport path such that presence or absence of paper passing through the paper transport path is detected by the photo-sensor and such detection signal is transmitted by way of signal lines. A further paper detecting apparatus is also known which includes a mechanical mechanism which is constituted such that a paper detecting member is provided for pivotal motion in a paper transport path and such pivotal motion of the paper detecting member is converted by way of a shaft into pivotal motion of an arm while an end of the arm is detected by means of a photo-sensor.

While such conventional paper detecting apparatus individually have various advantages and disadvantages, they can be used without much trouble where the distance between the paper detecting section and the controlling section is comparatively small. However, where the distance between the paper detecting section and the controlling section is great, in the case of a paper detecting apparatus of the type wherein a detection signal from a microswitch or a photo-sensor is transmitted by way of signal lines, a soldering operation and so forth are required, which requires a high production cost. Besides, a countermeasure for preventing the detecting section from serving as a source of noises and a countermeasure for assuring a resisting property to static electricity and so forth are required, which involves a considerably high cost. Further, since a photo-sensor is comparatively expensive, where a plurality of paper transport paths for detecting passage of paper are involved, a very high cost is required because a photo-sensor must be provided for each of such paper transport paths.

Meanwhile, in the case of a paper detecting apparatus which includes a mechanical mechanism, if the distance between the paper detecting section and the photo-sensor increases, then the amount of movement of an end of the arm increases progressively, and accordingly, a great spacing is required in a printer in order to assure an area for movement of the arm. Accordingly, it is a disadvantage that the printer must have a correspondingly great overall size.

SUMMARY OF THE INVENTION

Accordingly, it is an object of the present invention to provide a paper detecting apparatus for a printer by which, overcoming the drawbacks of the conventional paper detecting apparatus described above, no increase in cost is required nor dead space is produced in a printer even if the distance between a paper detecting section and a controlling section is great.

In accordance with an aspect of the present invention, there is provided a paper detecting apparatus for a printer for detecting paper which passes a paper transport path, which comprises paper detecting means provided in such a manner as to extend into the paper transport path and adapted to be pushed to pivot by paper which passes the paper transport path, motion converting and transmitting means for converting pivotal motion of the paper detecting means into another motion and transmitting the same to a remote location, and means for converting the motion transmitted by the motion converting and transmitting means into an electric signal.

Preferably, the motion converting and transmitting means converts pivotal motion of the paper detecting means into linear motion and transmits such linear motion to the remote location. Alternatively, the motion converting and transmitting means may convert pivotal motion of the paper detecting means into another pivotal motion of an arm mounted for pivotal motion around another axis and transmit the same to the remote location.

The paper transport path includes a first paper transport path and a second paper transport path, and the paper detecting means is adapted to be pivoted by paper which passes either of the first and second paper transport paths.

The above and other objects, features and advantages of the present invention and the manner of realizing them will become more apparent, and the invention itself will best be understood, from a study of the following description and appended claims with reference had to the attached drawings showing some preferred embodiments of the invention.

DESCRIPTION OF THE PREFERRED EMBODIMENTS

Figure 1:
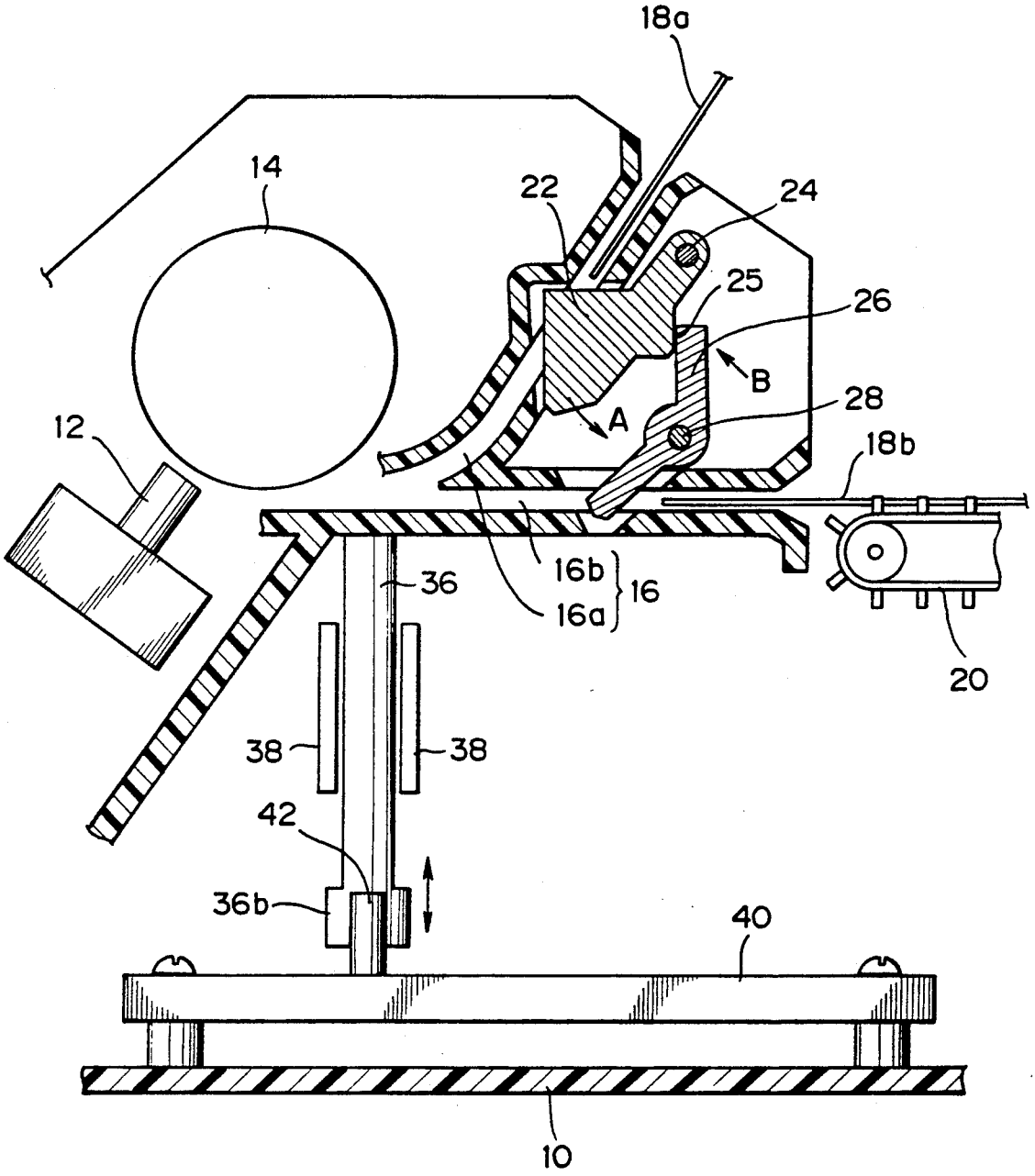
FIG. 1 is a sectional view of a paper detecting apparatus for a printer showing a first embodiment of the present invention.
Figure 2:
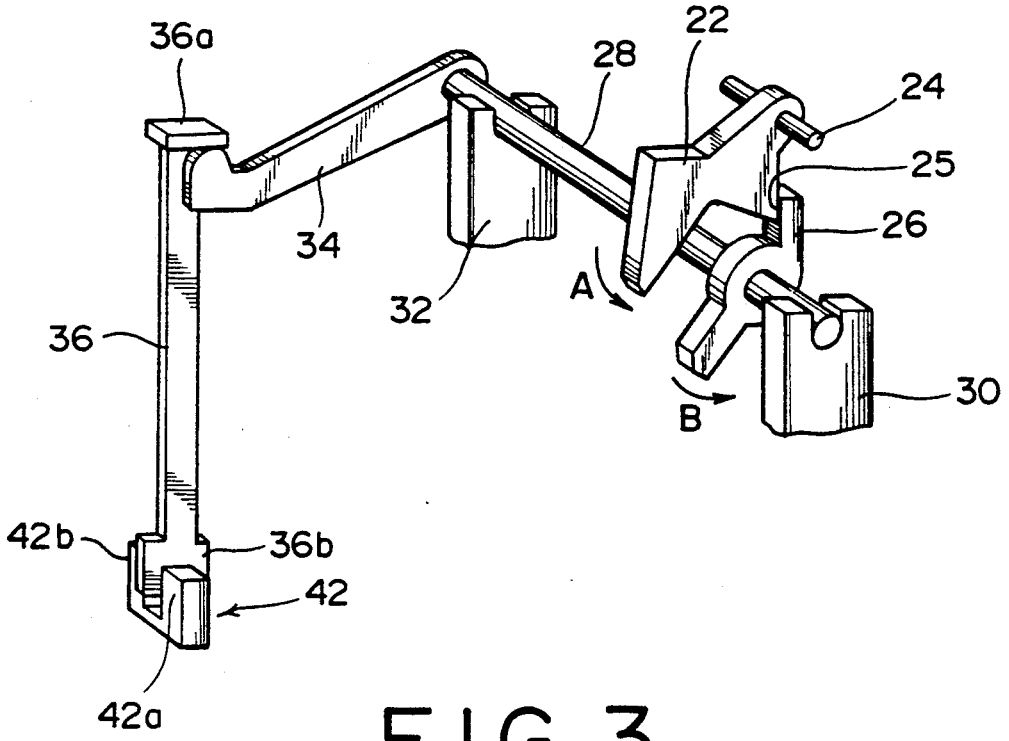
FIG. 2 is a partial perspective view of the paper detecting apparatus of FIG. 1.

Referring first to FIGS. 1 and 2, reference numeral 10 denotes a housing of a printer, and 12 a print head in which a plurality of print wires are accommodated. A platen roll 14 is disposed in an opposing relationship to the print head 12 such that those of the print wires which are projected from the print head 12 may collide with the platen roll 14, and paper is transported along a circumferential face of the platen roll 14.

Reference numeral 16 denotes a paper transport path, and the paper transport path 16 includes a first paper transport path 16*a* for transporting a cut paper sheet 18*a* and a second transport path 16*b* for transporting continuous form paper 18*b*. The two paper transport paths 16*a* and 16*b* are joined together in a Y-shape such that paper may be transported toward the platen roll 14. Reference numeral 20 denotes a pin belt tractor for feeding the continuous form paper 18*b* into the printer.

A first paper detecting member 22 and a second paper detecting member 26 are provided in the first and second paper transport paths 16*a* and 16*b* such that they are each pushed to pivot by paper 18*a* or 18*b* passing the same, respectively. The first paper detecting member 22 is supported for pivotal motion around a short shaft 24 secured to the housing 10. The first paper detecting member 22, however, may alternatively be secured to such short shaft 24 which is supported otherwise for rotation on the housing 10. On the other hand, the second paper detecting member 26 is securely mounted on a long shaft 28, and the long shaft 28 is supported for rotation by a pair of bearings 30 and 32 provided on the housing 10.

An arm 34 is securely mounted at an end of the long shaft 28 for integral rotation with the shaft 28 and extends perpendicularly from the shaft 28. Accordingly, when the second paper detecting member 26 is pivoted, the arm 34 is pivoted by the same angle in the same direction as the second paper detecting member 26 by way of the long shaft 28.

As shown in FIG. 2, a linearly movable member 36 having an upper end portion 36*a* bent laterally at right angles is placed simply at the upper end portion 36*a* thereof on an end of the arm 34 and is suspended downwardly by its own weight. The linearly movable member 36 makes linear motion in a vertical direction under the guidance of a pair of guide plates 38. Accordingly, if the second paper detecting member 26 makes pivotal motion, then the linearly movable member 36 makes up and down linear motion by way of the long shaft 28 and the arm 34.

A printed circuit board 40 constituting a controlling section is provided in the proximity of a bottom portion of the printer, and a photo-sensor 42 is mounted on the printed circuit board 40. The photo-sensor 42 includes a light emitting diode 42*a* and a photodiode 42*b*, and a lower end portion 36*b* of the linearly movable member 36 is normally inserted between the light emitting diode 42*a* and the photodiode 42*b* to normally keep the photo-sensor 42 in an off state. If the lower end portion 36*b* of the linearly movable member 36 is moved upwardly and a beam of light from the light emitting diode 42*a* is detected by the photodiode 42*b*, then the photo-sensor 42 is switched on. In this manner, a movement of the lower end portion 36*b* of the linearly movable member 36 is converted into an electric signal by the photo-sensor 42.

As shown in FIG. 1, the first paper detecting member 22 and second paper detecting member 26 normally contact with each other at contacting faces 25 thereof, and the first paper detecting member 22 is normally urged to pivot in the counterclockwise direction as indicated by an arrow mark A by its own weight while the second paper detecting member 26 is normally urged to pivot in the counterclockwise direction as indicated by another arrow mark B by weight of the arm 34 and linearly movable member 36. Then, since the weight of the arm 34 and linearly movable member 36 urging the second paper detecting member 26 to pivot in the direction of the arrow mark B is greater than the urging force by the weight of the first paper detecting member 22, when there is no paper present in either of the first and second paper transport paths 16*a* and 16*b*, the first and second paper detecting members 22 and 26 are projected into the first and second paper transport paths 16*a* and 16*b*, respectively, as shown in FIGS. 1 and 2. Consequently, the linearly movable member 36 is at its lowered position in which the lower end portion 36*b* thereof keeps the photo-sensor 42 in an off state.

Figure 3:
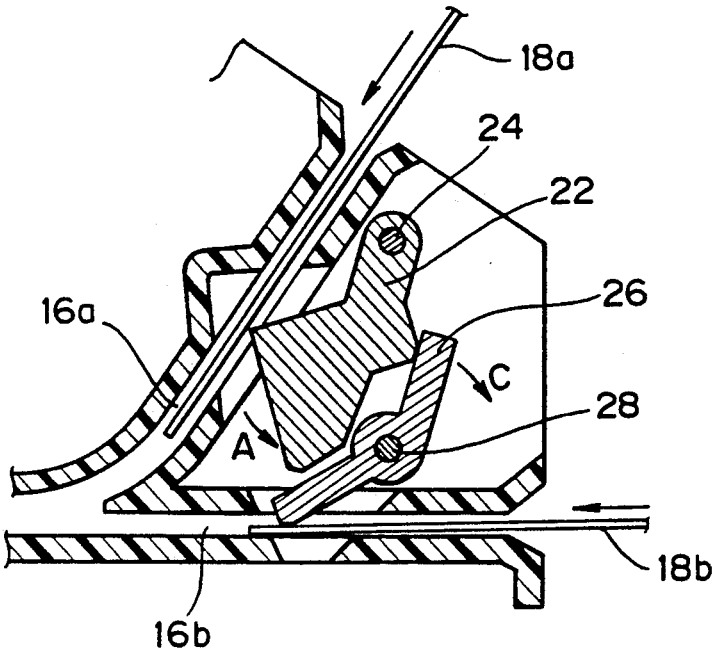
FIG. 3 is a partial sectional view of the paper detecting apparatus of FIG. 1 when paper passes the same.
Figure 4:
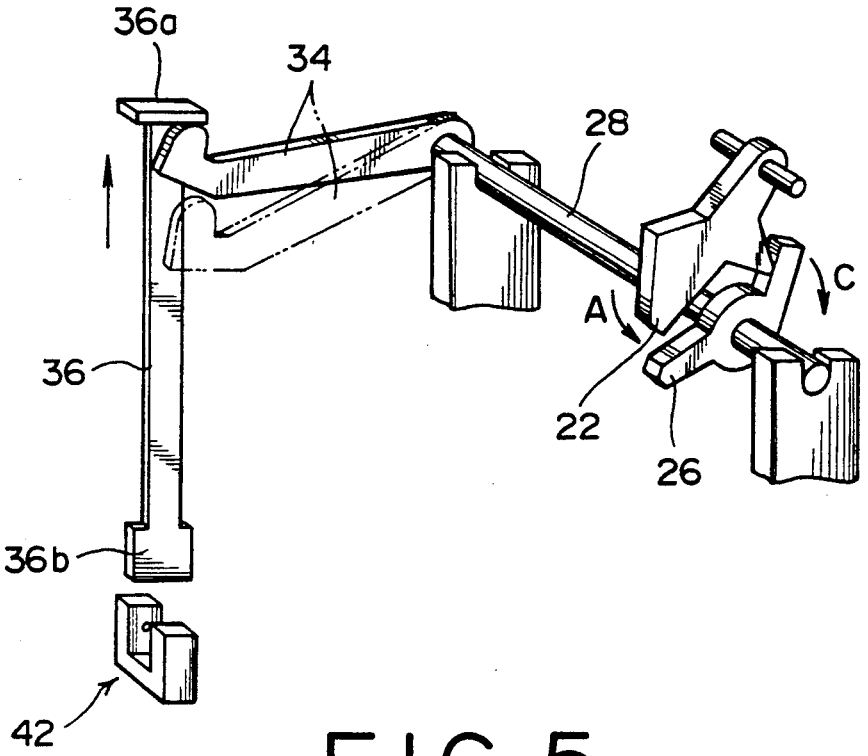
FIG. 4 is a partial perspective view of the paper detecting apparatus of FIG. 1 when paper passes the same.

When a cut paper sheet 18*a* passes the first paper transport path 16*a*, the first paper detecting member 22 is pushed to pivot in the direction indicated by the arrow mark A by the cut paper 18*a* so that it is retracted from the first paper transport path 16*a* as seen in FIGS. 3 and 4. Thereupon, the second paper detecting member 26 is pushed to pivot in the direction indicated by an arrow mark C by the first paper detecting member 22, and as a result, the linearly movable member 36 is pulled up by the arm 34 to retract the lower end portion 36*b* thereof from the photo-sensor 42 thereby to switch the photo-sensor 42 on.

On the other hand, when continuous form paper 18*b* passes the second paper transport path 16*b*, the second paper detecting member 26 is also pushed to pivot in the direction of the arrow mark C by the paper 18*b* so that it is retracted from the second paper transport path 16*b* as seen in FIGS. 3 and 4. As a result, the linearly movable member 36 is pulled up by way of the long shaft 28 and arm 34 to retract the lower end portion 36*b* thereof from the photo-sensor 42 thereby to switch the photo-sensor 42 on. When the second paper detecting member 26 is pivoted in the direction of the arrow mark C, the first paper detecting member 22 is permitted to be pivoted in the direction of the arrow mark A by its own weight so that the first and second paper detecting members 22 and 26 are normally kept in a mutually contacting condition.

In this manner, whichever one of the paper transport paths 16*a* and 16*b* the paper 18*a* or 18*b* passes, the lower end portion 36*b* of the linearly movable member 36 is pulled up to switch the photo-sensor 42 on, and accordingly, passage of paper is inputted as an electric signal to the controlling section provided on the printed circuit board 40.

According to the paper detecting apparatus for a printer of the first embodiment described above, pivotal motion of the first and second paper detecting members 22 and 26 is converted into linear motion of the linearly movable member 36 by way of the long shaft 28 and arm 34, and accordingly, a mechanical motion is transmitted to and detected by the photo-sensor 42 disposed remotely from the first and second paper detecting members 22 and 26 without requiring a great spacing for mechanical motion. With the paper detecting apparatus of the present embodiment, even when the printer is inclined, no influence is had on on-off operation of the photo-sensor, and accordingly, no detection error of paper will take place at all.

Figure 5:
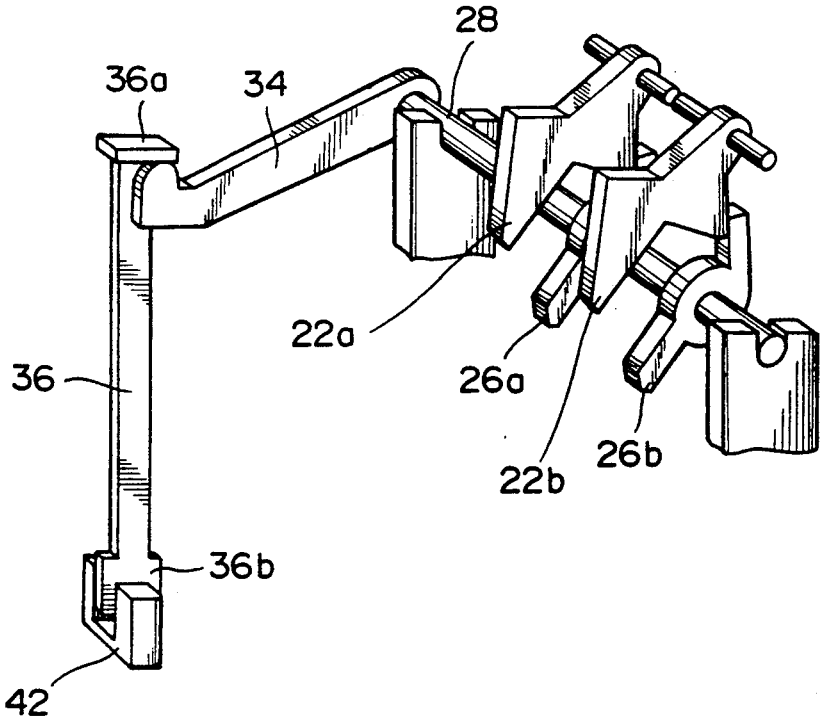
FIG. 5 is a partial perspective view of a paper detecting apparatus for a printer showing a second embodiment of the present invention.

Referring now to FIG. 5, there is shown a paper detecting apparatus for a printer of the second embodiment of the present invention wherein two first paper detecting members 22*a* and 22*b* and two second paper detecting members 26*a* and 26*b* are provided. Where a plurality of paper detecting members are provided for each of different types of paper, detection of paper of different sizes and detection of paper fed in a skew condition can be made with certainty to improve the accuracy in detection.

Figure 6:
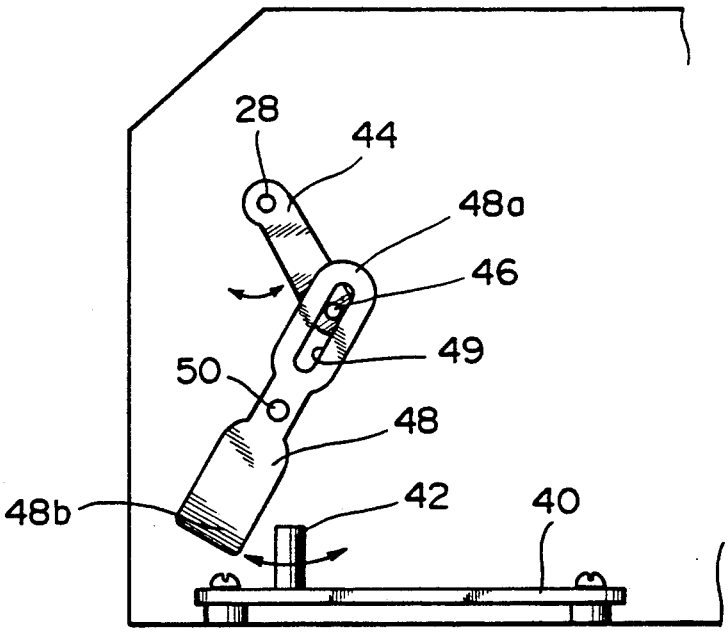
FIG. 6 is a partial side elevational view of a paper detecting apparatus for a printer showing a third embodiment of the present invention.

FIG. 6 shows a paper detecting apparatus for a printer of the third embodiment of the present invention. Referring to FIG. 6, a short arm 44 is securely mounted at an end thereof on a long shaft 28 which is in turn securely mounted on a paper detecting member not shown, and a pin 46 is secured to the other end of the arm 44. The pin 46 is engaged in an elongated hole 49 formed in an upper end portion 48*a* of a second arm 48 which is mounted for pivotal motion around a shaft 50, and a lower end portion 48*b* of the second arm 48 is selectively inserted into a photo-sensor 42 to switch the photo-sensor 42 off. In the paper detecting apparatus of the present embodiment, pivotal motion of the paper detecting member is not converted into linear motion but into another pivotal motion which does not require a great spacing therefor without the necessity of such conversion into linear motion.

According to a paper detecting apparatus for a printer of the present invention described so far, since pivotal motion of paper detecting means is converted into another motion of a different direction by motion converting and transmitting means and transmitted to signal converting means, even if the distance between a paper detecting section and a signal converting section is great, only a small spacing is required for motion of a motion transmitting section, and consequently, a possible dead space in the printer can be decreased and the printer can be made compact. Besides, since a microswitch, signal lines for the connection of the microswitch and so forth are not required, an increase in cost for electric countermeasures such as an electromagnetic countermeasure and a countermeasure for static electricity and for assembly does not take place.

What is claimed is:

1. A paper detecting apparatus for a printer for detecting paper which passes a paper transport path, comprising:

paper detecting means provided in such a manner as to extend into said paper transport path and adapted to be pushed to pivot by paper which passes said paper transport path;

motion converting and transmitting means for converting pivotal motion of said paper detecting means into linear motion and transmitting said linear motion to a remote location; and means for converting the motion transmitted by said motion converting and transmitting means into an electric signal.

2. A paper detecting apparatus for a printer according to claim 1, wherein said paper transport path includes a first paper transport path and a second paper transport path, and said paper detecting means is adapted to be pivoted by paper which passes either of said first and second paper transport paths.

3. A paper detecting apparatus for a printer according to claim 2, wherein said paper detecting means includes a first detecting member adapted to be pivoted in one direction around a first axis by paper which passes said first paper transport path, and a second detecting member adapted to be pivoted in the opposite direction around a second axis parallel to the first axis by paper which passes said second paper transport path, and said first and second detecting members are normally urged to contact each other.

4. A paper detecting apparatus for a printer for detecting paper which passes a paper transport path, comprising:

paper detecting means provided in such a manner as to extend into said paper transport path and adapted to be pushed to pivot by paper which passes said paper transport path;

motion converting and transmitting means for converting pivotal motion of said paper detecting means into linear motion and transmitting said linear motion to a remote location, said motion converting and transmitting means including a shaft mounted for rotation together with said paper detecting means, an arm securely mounted for integral rotation at an end of and extending perpendicularly to said shaft, and a linearly movable member having an end engaging with an end of said arm and extending downwardly from the end of said arm, and means for converting the motion transmitted by said motion converting and transmitting means into an electric signal.

* * * * *

UNITED STATES PATENT AND TRADEMARK OFFICE

CERTIFICATE OF CORRECTION

PATENT NO. : 5,082,384

DATED : January 21, 1992

INVENTOR(S) : KAKUGUCHI

It is certified that error appears in the above-identified patent and that said Letters Patent is hereby corrected as shown below:

On the cover page, item [75], should read --KAKUGUCHI--.
Also Item [19] should be changed.

Signed and Sealed this

Eighth Day of June, 1993

*Attest:*

Michael K. Kirk

MICHAEL K. KIRK

*Attesting Officer*

*Acting Commissioner of Patents and Trademarks*